US007000888B2

(12) United States Patent
Wright et al.

(10) Patent No.: US 7,000,888 B2
(45) Date of Patent: Feb. 21, 2006

(54) PUMP ROD CLAMP AND BLOWOUT PREVENTER

(75) Inventors: Andrew J. Wright, Edmonton (CA); James Bentley, Beaumont (CA)

(73) Assignee: Gadu, Inc., (BB)

( * ) Notice: Subject to any disclaimer, the term of this patent is extended or adjusted under 35 U.S.C. 154(b) by 67 days.

(21) Appl. No.: 10/810,704

(22) Filed: Mar. 29, 2004

(65) Prior Publication Data

US 2005/0211428 A1 Sep. 29, 2005

(51) Int. Cl.
*E21B 7/00* (2006.01)

(52) U.S. Cl. ..... 251/1.3; 251/1.1

(58) Field of Classification Search ..... 251/1.1, 251/1.2, 1.3
See application file for complete search history.

(56) References Cited

U.S. PATENT DOCUMENTS

| | | | | |
|---|---|---|---|---|
| 1,048,705 | A | 12/1912 | Klefman | |
| 1,578,696 | A | 3/1926 | Wright | |
| 1,590,160 | A | 6/1926 | Gluyas | |
| 1,664,709 | A | 4/1928 | Severns et al. | |
| 1,855,347 | A | 4/1932 | Goble | |
| 2,173,355 | A | 9/1939 | Criswell | |
| 2,463,755 | A | 3/1949 | Edwards | |
| 2,660,248 | A | 11/1953 | Brown | |
| 2,746,710 | A | 5/1956 | Jones | |
| 2,919,111 | A | 12/1959 | Nicolson | |
| 2,960,357 | A | 11/1960 | Scaramucci | |
| 3,475,798 | A | 11/1969 | Crickmer | |
| 3,690,381 | A | 9/1972 | Slator et al. | |
| 3,736,982 | A | 6/1973 | Vujasinovic | |
| 4,522,368 | A * | 6/1985 | Sable | 251/1.2 |
| 4,576,067 | A | 3/1986 | Buck | 81/185.1 |
| 4,825,948 | A | 5/1989 | Carnahan | |
| 4,844,406 | A | 7/1989 | Wilson | 251/1.3 |
| 4,860,826 | A | 8/1989 | Land | |
| 5,291,808 | A | 3/1994 | Buck | |
| 5,327,961 | A | 7/1994 | Mills | |
| 5,725,193 | A | 3/1998 | Adams | |
| 5,743,332 | A | 4/1998 | Lam et al. | |

(Continued)

FOREIGN PATENT DOCUMENTS

CA 2266367 3/1998

(Continued)

OTHER PUBLICATIONS

"Texas Oil Tools, The Cutting Edge in Technology & Service" Apr. 1999.

(Continued)

*Primary Examiner*—J. Casimer Jacyna
(74) *Attorney, Agent, or Firm*—Merek, Blackmon & Voorhees, LLC

(57) ABSTRACT

A pump rod clamp for gripping a pump rod in an oil, gas or water well. The pump rod clamp comprises a central housing having a longitudinal bore for receiving a pump rod, a plurality of clamping members receivable within the central housing, and one or more actuators to cause the clamping members to be moved between an activated position where they grippingly engage the pump rod and a deactivated position where they are released from contact with the pump rod. Each of the clamping members have a leading face that includes one or more gripping inserts releasably secured thereto. The gripping inserts having outer faces generally aligned with the pump rod for grippingly engaging the pump rod when the clamping members are in their activated position such that force exerted by each individual clamping member against the pump rod is concentrated and distributed over the outer faces of the one or more gripping inserts of each clamping member.

20 Claims, 10 Drawing Sheets

U.S. PATENT DOCUMENTS

| | | | | |
|---|---|---|---|---|
| 5,746,249 | A | 5/1998 | Wright et al. | |
| 5,765,813 | A | 6/1998 | Lam et al. | |
| 5,875,841 | A | 3/1999 | Wright et al. | |
| 6,012,528 | A * | 1/2000 | Van Winkle | 166/339 |
| 6,223,819 | B1 | 5/2001 | Heinonen | |
| 6,378,399 | B1 | 4/2002 | Bangert | |
| 6,595,278 | B1 | 7/2003 | Lam et al. | |

FOREIGN PATENT DOCUMENTS

| | | |
|---|---|---|
| CA | 2216456 | 12/2000 |
| CA | 2311036 | 12/2001 |
| CA | 2280581 | 2/2002 |
| CA | 2349988 | 5/2002 |

OTHER PUBLICATIONS

"Composite Catalog of Oil Field Equipment & Services 38th Revision 1988-1989 in 3 Volumes" 1988.
"Composite Catalog of Oil Field Equipment & Sevices, 39th Revision 1990-91 in 2 Volumes" 1990.
"Composite Catalog of Oil Field Equipment & Sevices, 40th Revision 1992-93 in 2 Volumes" 1992.
"Composite Catalog of Oil Field Equipment & Services, 41st Revision 1994-95 in 2 Volumes" 1994.
"Composite Catalog of Oil Field Equipment & Services, 42nd Revision 1996-97 in 2 Volumes" 1996.
"Composite Catalog of Oil Field Equipment & Services, 43rd Revision 1998-99 in 2 Volumes" 1998.
"Texas Oil Tools, 3.06 10M COMBI" Jun. 1996.
Double-E, Inc., Drawing No. C12LP2 with attachment, alleged to have been published more than one year prior to filing date of subject patent application in Canadian Federal Court litigation.
"Blowout Preventer Equipment" 1 page.
One page excerpt from 1957 Composite Catalog, p 4417.
Excerpts from 1982-1983 Composite Catalog.
Print out from Web page of Double E, Inc.
Double E, Inc. brochure, 1997.
Two drawings of Double E, Inc. dated 1994.
Excerpts from Bowen Tools, Inc, 1978-1979 catalog.
Excerpts from Cameron 1996-1997 Catalog.
Print out from Internet Web page of Cameron.
NORMEC Oilfield Products Brochure.
Composite Catalogue of Oil Field Equipment and Services, 1957.
Composite Catalogue of Oil Field Equipment and Service, 1982-83.
Bowen Tools, Inc.1978-1979 General Catalog.

* cited by examiner

PUMP ROD CLAMP AND BLOWOUT PREVENTER

FIELD OF THE INVENTION

This invention relates generally to a pump rod clamp and blowout preventer as may be used on oil, gas water wells, and in particular a new and improved pump rod clamp and blowout preventer having an enhanced polished rod clamping or gripping capability.

BACKGROUND OF THE INVENTION

The use of pump rod clamps and blowout preventers on oil, gas and water wells is a common occurrence. Pump rod clamps are used generally to hold the pump or polished rod and may take any one of a wide variety of forms ranging from a pair of rams that are driven radially inward in order to contact the pump rod and hold it in place, to wedges that may be inserted around the rod, to a pair of clamping members that may be bolted around the exterior surface of the rod and hung from a mandrel or other support member. Regardless of the particular structure of the clamp, its primary purpose is to either suspend the rod within the well, and/or to prevent rotational movement of the pump rod.

Blowout preventers (or BOP's as they are typically called) are critical pieces of equipment that are used to seal off the well and contain its contents under a variety of different situations. For example, during the servicing of a wellhead one or more blowout preventers are often used to seal against the pump or polished rod to contain the contents of the well when downstream equipment is removed or disassembled for servicing. In other instances blowout preventers may be used to seal off a well where the pump rod is removed, or in the event of a failure of the pump rod.

Blowout preventers that are used in producing oil and gas wells are most commonly comprised of a pair of rams that are received within cylinders or bores extending through a BOP housing and situated generally perpendicular to the longitudinal axis of the well casing. Typically the end of each ram has a semi-circular channel on its face to allow it to seal against the exterior surface of the polished rod when driven inwardly. The faces of the rams may include an elastomer or other sealing mechanism to ensure that a fluid tight seal is created when the rams fully engage the polished rod. Examples of such prior existing blowout preventers are described in U.S. Pat. Nos. 4,860,826, 5,746,249, and 5,875,841.

While currently available blowout preventers are generally effective in sealing around a polished rod and preventing the contents of a well from escaping, they nevertheless suffer from a number of inherent limitations. In order to ensure a tight seal between the rams and the polished rod, particularly where the well is a high pressure well or contains natural gas or hydrogen sulfide, operators have developed a tendency to drive the rams inwardly against the polished rod using a considerable amount of force. While doing so has the effect of compressing the elastomer against the rod and helping to ensure a good seal, in many cases the metal faces of the rams are also driven into contact with the exterior surface of the rod. In some cases rig hands intentionally drive the faces of the rams into the polished rod as a means to not only seal off the well, but to also effectively act as a rod clamp to hold the polished rod in place. Where the pump in question is a reciprocating pump, the rams may be used to maintain or hold the weight of the rod while work is performed upon components downstream of the BOP. Where the pump is a rotary style pump, the rams may be used to both hold the weight of the polished rod and to prevent rotation caused through backspin forces applied to the rotor of the pump by the head of fluid in the well. In either case, use of the BOP rams to not only seal the well but to grasp or clamp the rod can have the effect of marking or scoring the exterior surface of the rod and/or the face of the ram, neither of which is desirable. Further, when the metallic faces of the rams contact the exterior of the polished rod an electrical connection will be formed therebetween, which in some circumstances may also be undesirable.

Currently available polished rod clamps are also not without their limitations. Where the well is equipped with a separate polished rod clamp the overall height of the wellhead will be increased by the height of the clamp. Use of a dedicated rod clamp also results in an increase in equipment cost and represents a further mechanical component that may malfunction or fail. In addition, the use of a separate polished rod clamp does not prevent an operator from over tightening the BOP rams and causing their metal faces to score or damage the surface of the polished rod.

SUMMARY OF THE INVENTION

The invention therefore provides a pump rod clamp and blowout preventer that is in the form of a single component capable of both sealingly engaging a polished rod to prevent the escape of fluid from a well, while at the same time providing an enhanced ability to clamp or grip the rod and to prevent or retard axial and/or rotational movement. In one embodiment the invention further provides a mechanism by which the polished rod may be clamped and securely held without scoring or damaging the exterior surface of the rod, and without the formation of an electrical bonding between the invention and the pump rod.

Accordingly, in one of its aspects the invention provides a pump rod clamp for gripping a pump rod in an oil, gas or water well, the pump rod clamp comprising a central housing having a longitudinal bore for receiving a pump rod; a plurality of clamping members receivable within said central housing; and, one or more actuators to cause said clamping members to be moved between an activated position where they grippingly engage the exterior surface of the pump rod and a deactivated position where they are released from contact with the exterior surface of the pump rod, each of said clamping members having a leading face that includes one or more gripping inserts releasably secured thereto, said gripping inserts having outer faces generally aligned with the exterior surface of the pump rod and for grippingly engaging the pump rod when said clamping members are in said activated position such that force exerted by each individual clamping member against the pump rod is concentrated and distributed over said outer faces of said one or more gripping inserts of said individual clamping member.

In a further aspect the invention provides a pump rod clamp for gripping a pump rod in an oil, gas or water well, the pump rod clamp comprising a central housing having a longitudinal bore for receiving a pump rod, said central housing including at least one pair of opposed radial bores generally perpendicular to said longitudinal bore and having interior ends terminating at said longitudinal bore; a ram received within each of said opposed radial bores, each of said rams having a leading face generally directed toward the exterior surface of the pump rod; and, one or more actuators to cause said rams to be moved within said opposed radial bores between an activated position where said rams grippingly engage the pump rod to limit rotational and axial movement thereof, and a deactivated position where said rams are disengaged from the pump rod, each of said rams including one or more gripping inserts releasably securable to their leading faces such that when said rams are in said activated position said gripping inserts contact the exterior surface of the pump rod, said gripping inserts having outer faces with an arcuate shape generally corresponding to the curvature of the exterior of the pump rod and coated with a ceramic material, said ceramic material enhancing the ability of said gripping inserts to grippingly engage the pump rod and providing an electrically insulative barrier between said pump rod clamp and the pump rod when said clamping members are in said activated position.

The invention also concerns a clamping blowout preventer for gripping a pump rod in an oil, gas or water well, the clamping blowout preventer comprising a central housing having a longitudinally oriented bore for receiving a pump rod, said central housing including at least two radially opposed bores generally perpendicular to said longitudinal bore and having interior ends terminating at said longitudinal bore; a ram received within each of said radially opposed bores, each of said rams having a leading face generally directed toward the exterior surface of the pump rod, said leading faces of said rams including one or more gripping inserts releasably secured thereto; at least one actuator to cause said rams to be moved between an activated and deactivated position, when in said activated position said rams driven inwardly toward the pump rod causing said gripping inserts to grippingly engage the exterior surface of the pump rod and to limit axial and rotational movement thereof, when in said deactivated position said rams retracted from the pump rod permitting said gripping inserts to be released from engagement with the pump rod; and, a seal secured to each of said rams such that the seals on opposed rams engage both the exterior surface of the pump rod and one another when said rams are in said activated position, to limit well fluids from escaping from the well.

In yet a further aspect the invention provides a pump rod clamp for gripping a pump rod in a oil, gas or water well, the pump rod clamp comprising central housing having a longitudinal bore for receiving a pump rod; a plurality of clamping members received within said central housing; and, one or more actuators to cause said clamping members to be moved between an activated position where they grippingly engage the exterior surface of the pump rod and a deactivated position where they are released from contact with the exterior surface of the pump rod, each of said clamping members comprising a ram received within a radial bore extending through said central housing generally perpendicular to said longitudinal bore and having an interior end terminating at said longitudinal bore, each of said rams having a leading face with an arcuate channel thereon for grippingly engaging the pump rod when said rams are in said activated position, said arcuate channel coated with a ceramic material to enhance the ability of said arcuate channel to grippingly engage the pump rod and to provide an electrically insulative barrier between said pump rod clamp and the pump rod when said rams are in said activated position.

Further aspects and advantages of the invention will become apparent from the following description taken together with the accompanying drawings.

BRIEF DESCRIPTION OF THE DRAWINGS

For a better understanding of the present invention, and to show more clearly how it may be carried into effect, reference will now be made, by way of example, to the accompanying drawings which show the preferred embodiments of the present invention in which.

DESCRIPTION OF THE PREFERRED EMBODIMENT

The present invention may be embodied in a number of different forms. However, the specification and drawings that follow describe and disclose only some of the specific forms of the invention and are not intended to limit the scope of the invention as defined in the claims that follow herein.

Figure 1:
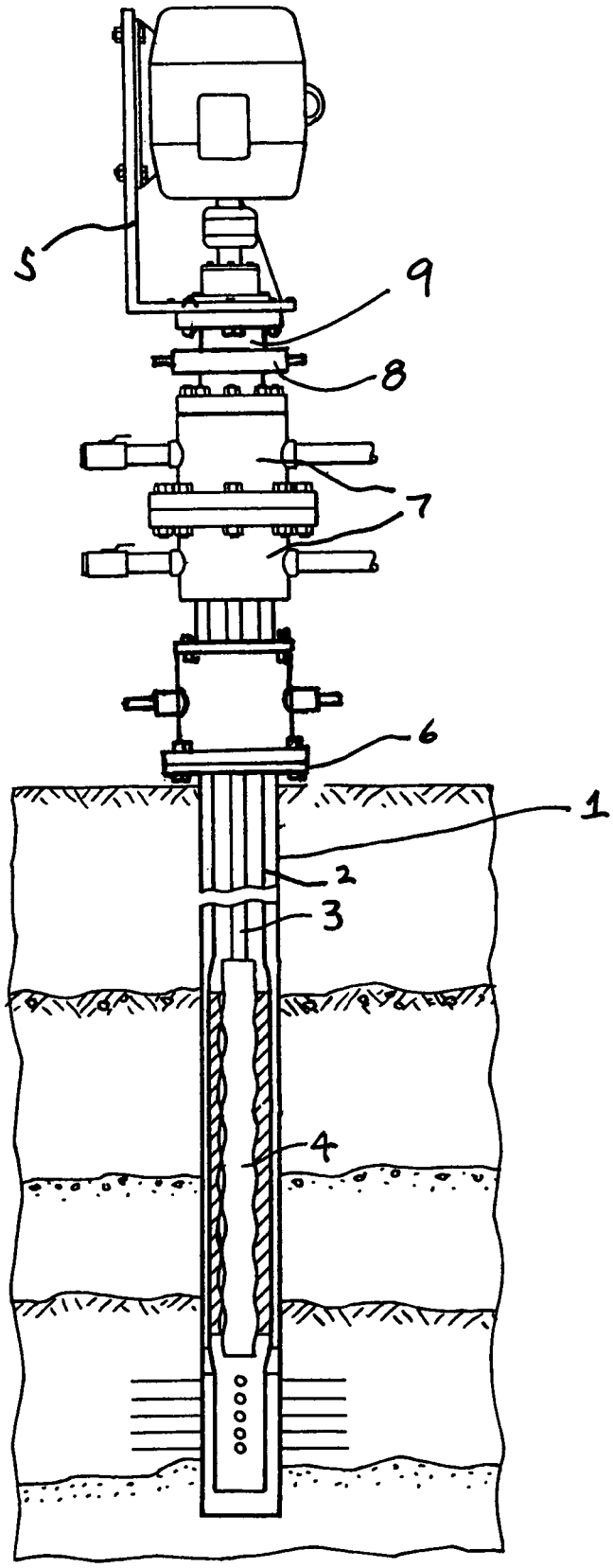
FIG. 1 is a side view of a typical oil or gas well having an embodiment of a pump rod clamp and blowout preventer in accordance with one embodiment of the present invention mounted thereon.
Figure 14:
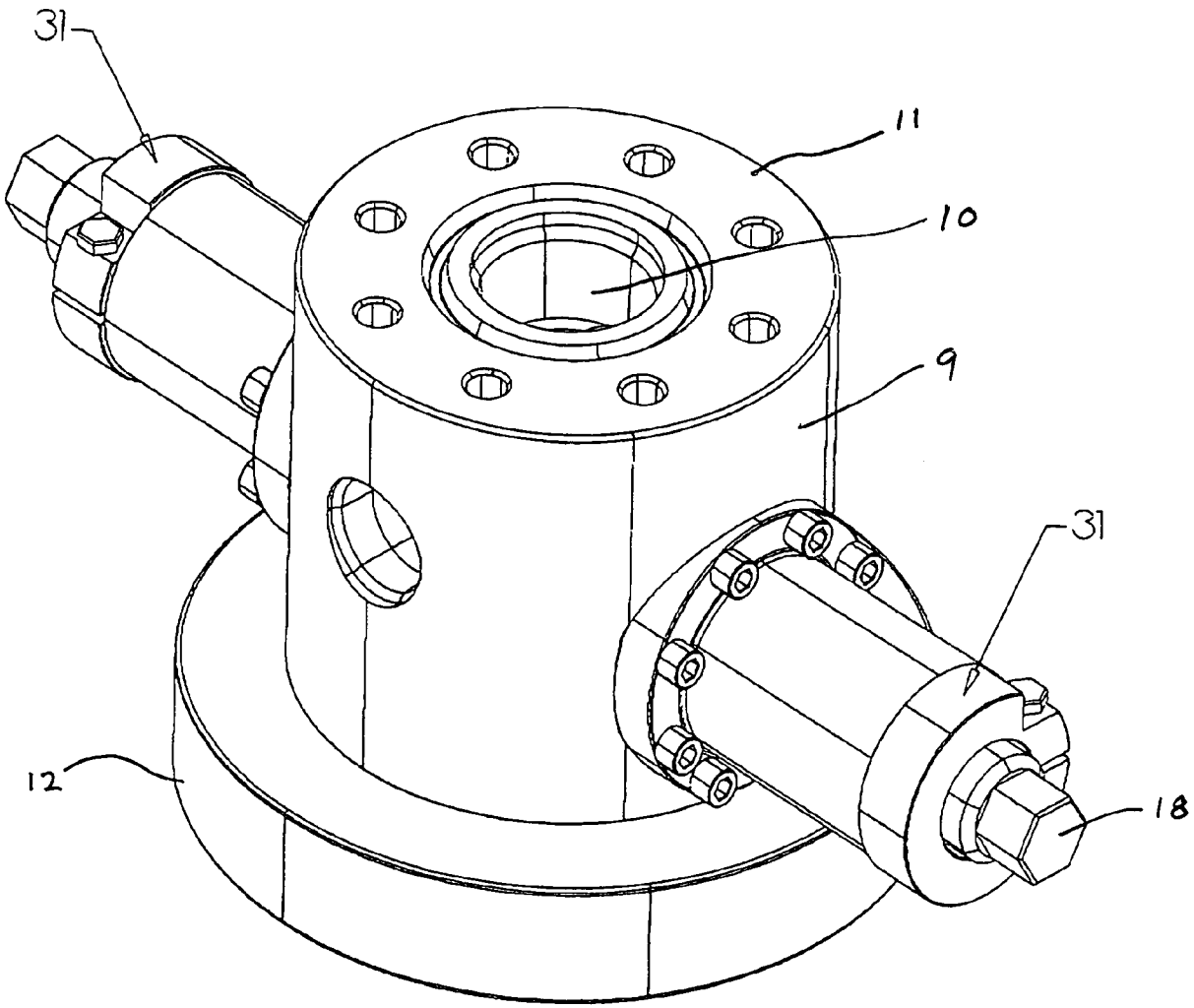

FIG. 1 is a cross sectional view of a relatively standard oil well. It will be appreciated that depending upon the particular well in question, the set up of the well and the type of equipment used could vary substantially. FIG. 1 depicts but one example of a producing well. In FIG. 1 the well is comprised generally of a casing 1 that extends from the surface of the earth down into an the oil bearing strata. Situated within the casing is a tubing string 2. Within the tubing string there is located a polished rod 3 for driving a downhole pump 4. In the embodiment shown, the pump is a rotary pump with polished rod 3 connected to a rotary drive head 5. Where casing 1 exits the earth there is provided a casing bowl 6 to which is mounted a flow tee 7. Immediately above flow tee 7 is a pump rod clamp and blowout preventer 8 constructed in accordance with one of the preferred embodiments of the present invention. The exterior structure of the pump rod clamp and blowout preventer is shown in FIG. 14.

Figure 2:
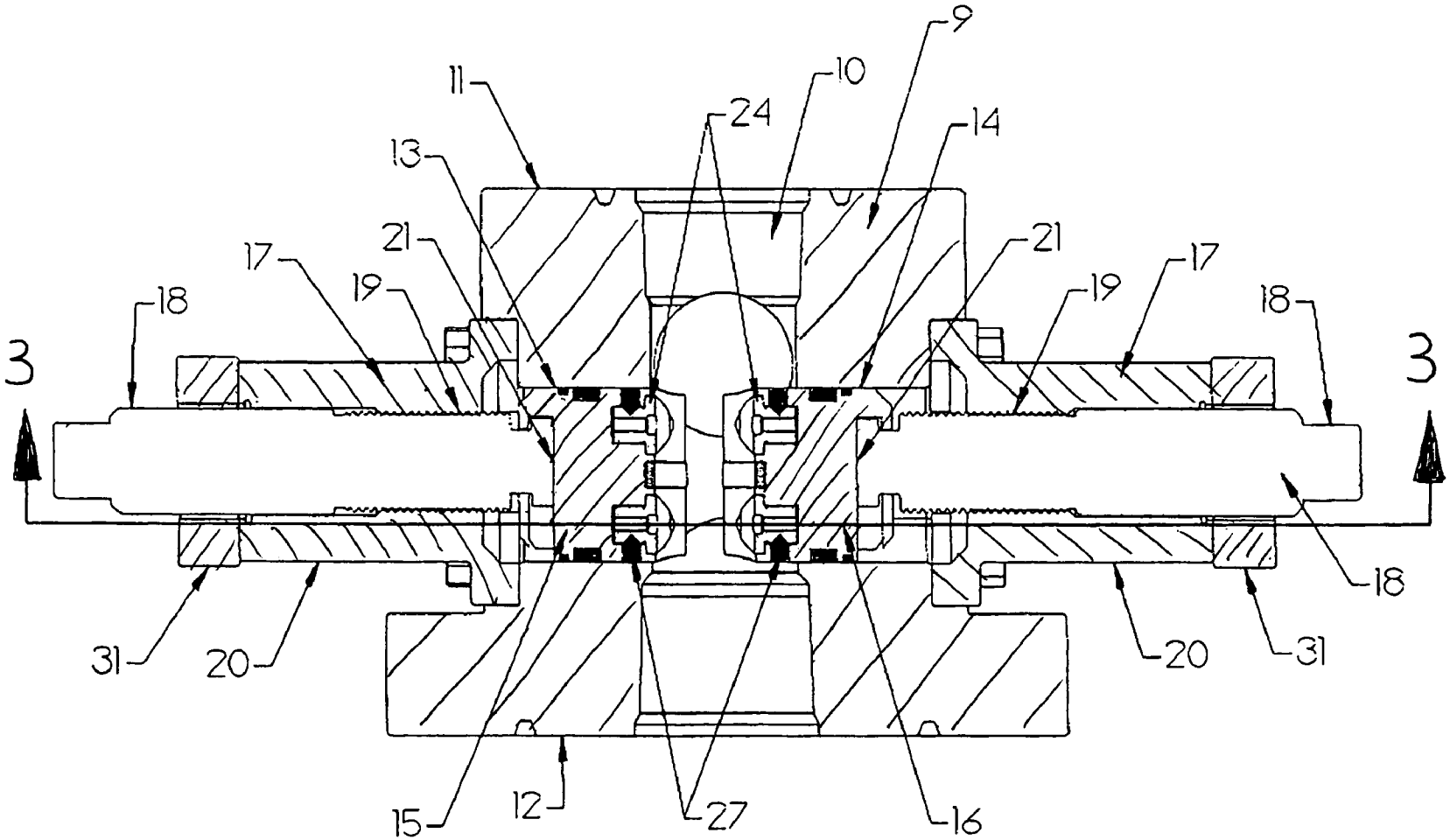
FIG. 2 is a side sectional view of a preferred embodiment of the pump rod clamp and blowout preventer of FIG. 1 shown in an open configuration.
Figure 3:
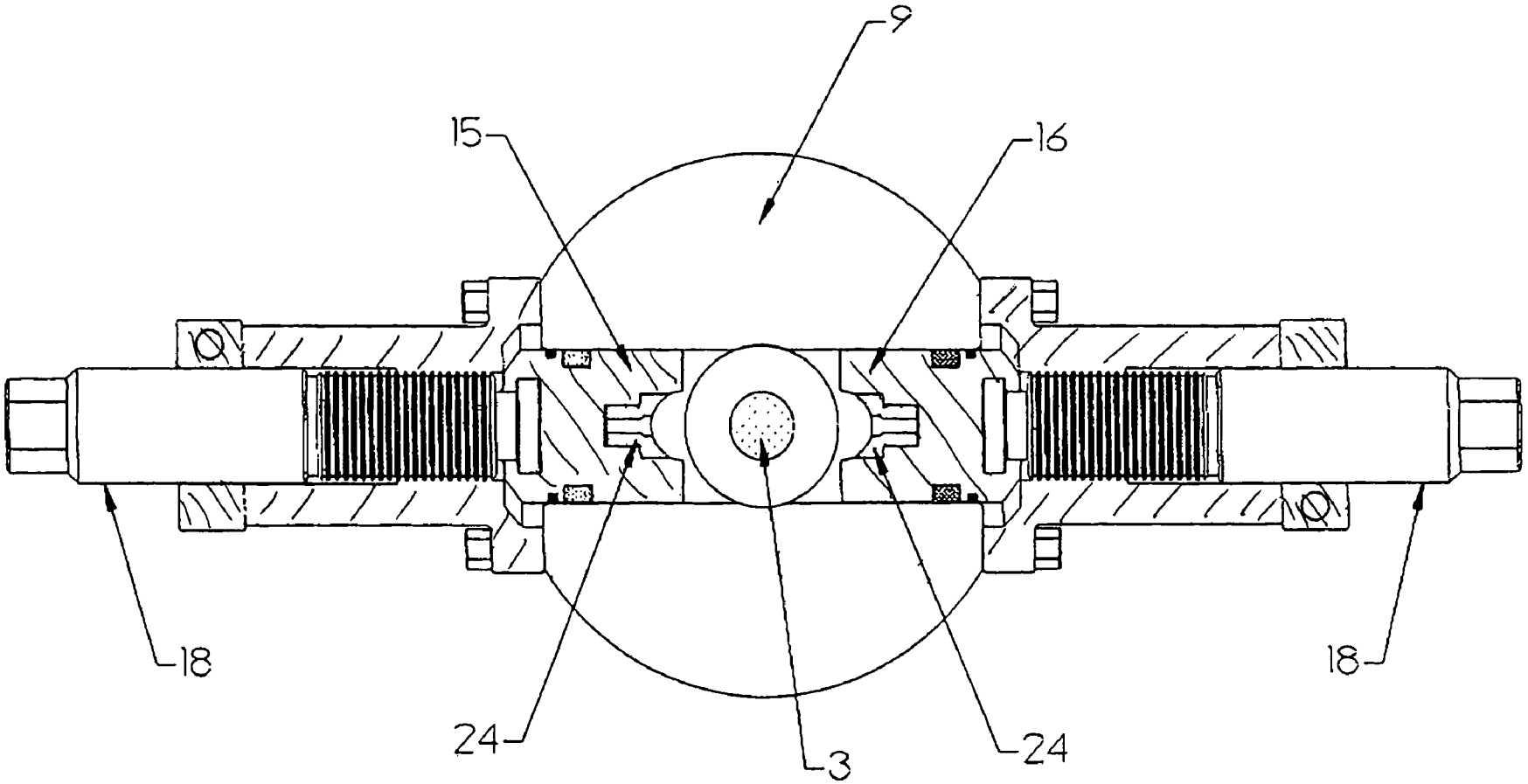
FIG. 3 is a sectional view taken along the line 3—3 of FIG. 2.
Figure 4:
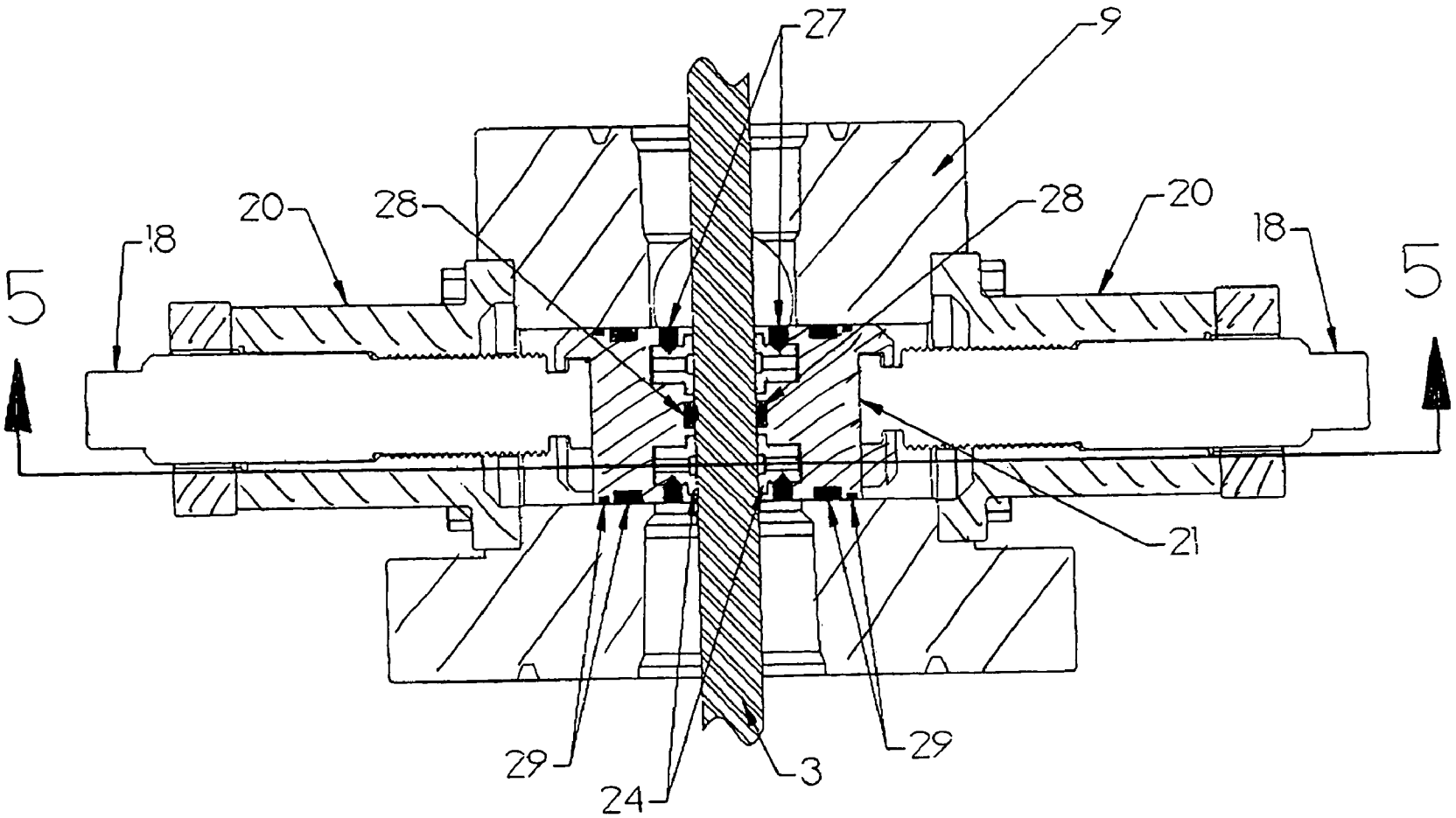
FIG. 4 is a side sectional view of the pump rod clamp and blowout preventer of FIG. 2 shown in a closed configuration.
Figure 5:
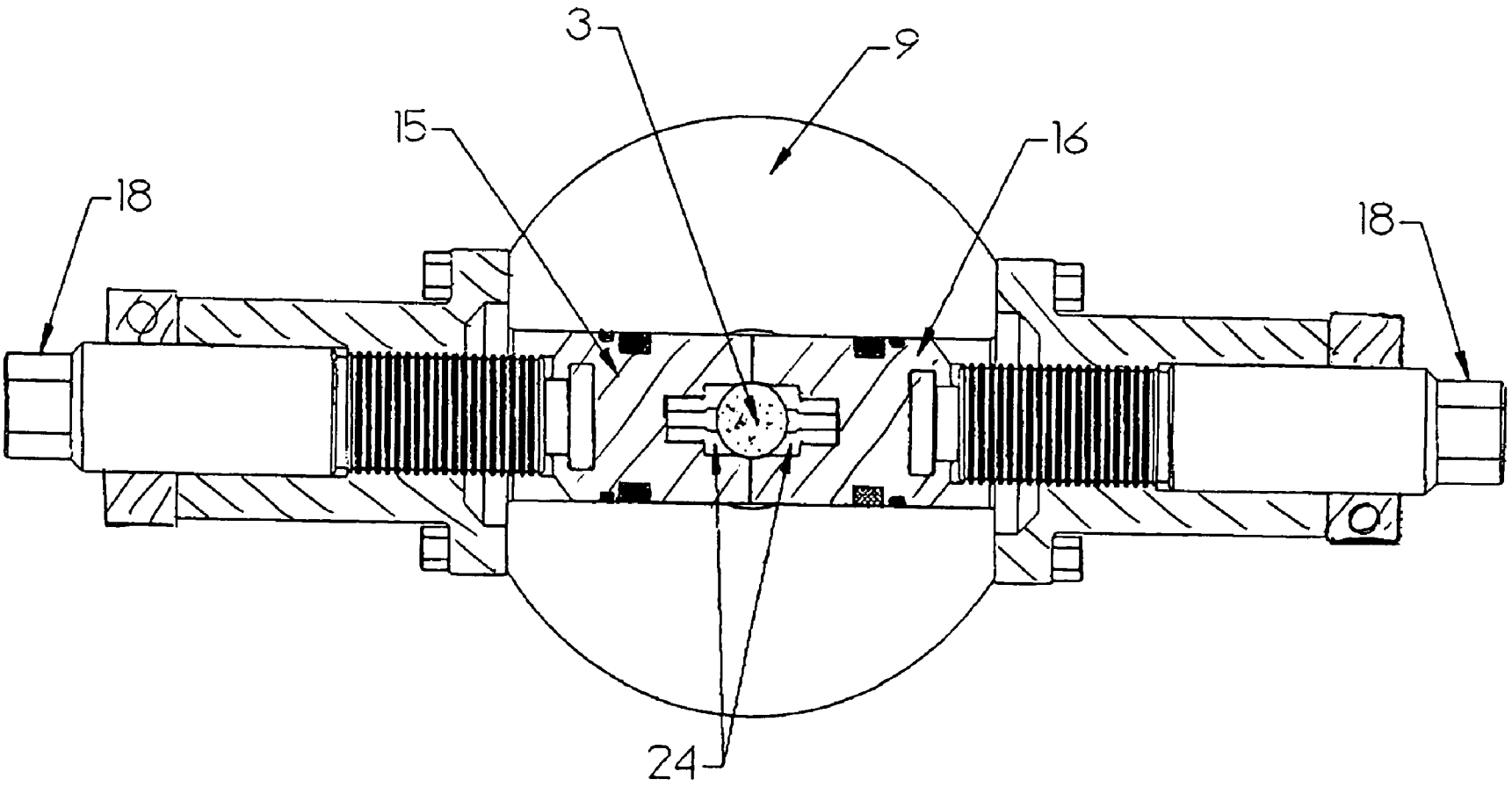
FIG. 5 is a sectional view taken along the line 5—5 of FIG. 4.

Details of the internal structure of pump rod clamp and blowout preventer 8 are shown in FIG. 2. The embodiment of the pump rod and blowout preventer shown in FIG. 2 comprises, in general, a central housing 9 having a longitudinal bore 10 extending therethrough and for receiving a pump rod 3. Central housing 9 may contain upper and lower flanges or threaded connections, 11 and 12 respectively, for mounting the housing to wellhead equipment. As is common with most blowout preventers, central housing 9 further includes a pair of opposed radial bores 13 and 14 that are generally perpendicular to, and that terminate at, longitudinal bore 10. A pair of clamping members 15 and 16, which in the embodiment shown in the attached drawings are in the general form of a pair of rams, are slidably received within bores 13 and 14. One or more actuators 17 are used to cause clamping members 15 and 16 to be moved between an activated position where they extend into longitudinal bore 10 to a point where they may grippingly engage the exterior surface of the pump rod, to a deactivated position where there are released from contact with the exterior surface of the pump rod and retracted outwardly through bores 13 and 14. A variety of different actuators may be utilized in order to move the clamping members or rams between their activated and deactivated positions. Such mechanisms include manual, hydraulic, pneumatic, or electric means. In the embodiment shown, actuators 17 are comprised of a pair of stems 18, that are each threadably received within a bore 19 situated within blowout preventer plugs 20 received within radial bores 13 and 14. The inner most ends 21 of the stems are attached to the clamping members or rams, but are free to rotate relative thereto.

The outer most ends of the stems extend beyond central housing 9 such that they may be rotated manually, electrically, pneumatically or hydraulically, in order to drive the clamping members or rams either inwardly or outwardly relative to longitudinal bore 10. A stem lock 31, at the outermost end of each plug 20, may be used to permit the stems to be locked in place in order to prevent unintentional or accidental rotation and movement of the clamping members.

In a preferred embodiment of the invention, rams 15 and 16 have a leading face 22 that is directed generally toward longitudinal bore 10 (and hence the exterior surface of a pump rod received within the longitudinal bore). Leading faces 22 include an arcuate channel 23 positioned thereon and in general alignment with longitudinal bore 10 and a pump rod received therein. Arcuate channels 23 are positioned in such a manner that, when the rams are moved inwardly to their activated position, leading faces 22 encompass the pump rod, and depending upon the particular embodiment of the invention in concern, grippingly engage the exterior surface of the rod.

As shown in FIGS. 2 through 8, each of clamping members or rams 15 and 16 in one embodiment include one or more gripping inserts 24 releasably secured to their leading faces 22 within arcuate channel 23. Gripping inserts 24 have outer faces 25 that are generally aligned with the exterior surface of the pump rod and that grippingly engage the rod when the rams are in their activated position. In this manner the loading or force applied to the rams by actuators 17 will be concentrated and distributed over the outer faces 25 of gripping inserts 24. Where the total combined surface area of the outer faces of the gripping inserts on each individual ram is less than the surface area of arcuate channel 23 there will be a concentrated load applied to the exterior surface of the pump rod through the gripping inserts. This concentration of load assists in gripping the polished or pump rod to securely hold it in place when the rams have been moved to their activated position by means of actuator 17.

To enhance their ability to transmit concentrated loads from the rams to the pump rod, gripping inserts 24 are preferably formed from a hardened metal or steel Further, outer faces 25 of gripping inserts 24 are preferably arcuate in shape, generally corresponding to the curvature of the exterior surface of the pump rod. Outer faces 25 may also include horizontal, vertical or horizontally inclined ridges or teeth to enhance gripping of the pump rod and limit or prevent rotational and/or longitudinal movement.

To increase the ability of device 8 to grippingly engage the exterior surface of a pump rod, in a preferred embodiment of the invention outer faces 25 of gripping inserts 24 are coated with a ceramic material 32 (see FIGS. 10 through 13). The ceramic coating upon the gripping inserts serve to present a hard, non-metallic surface for engaging the exterior of the pump rod without scoring or galling the rod. Traditional rod clamps that permit metal-to-metal contact often gall the surface of the rod and create burs, ridges, and other marks which can have the effect of ripping or tearing packing material when the rod is pulled from the well. In contrast, gripping inserts 24, having a ceramic coated outer face, reduce the likelihood of damage to the exterior of the rod. The concentrated loading applied through the gripping inserts has a tendency to create small indentations within the rod's exterior surface, as opposed to scratches, galling, scoring, or other forms of damage. Any small indentations formed on the surface of the rod will have no detrimental effect upon packing material and/or seals when the rod is removed from the well. To further enhance the ability of gripping inserts 24 to securely hold the pump rod the ceramic coating applied to their outer faces may have a slightly roughened texture.

The ceramic coating upon gripping inserts 24 also serves to present an electrically insulative barrier between the pump rod and the rod clamp when the rams are in their activated position. The electrically insulated barrier between the rod and the grippers helps to ensure that no static sparks are created between the rod and the grippers, and insulates the entirety of the pump rod clamp and blowout preventer from the rod to prevent electrical arcing should there be an electrical short in electrical equipment connected to the wellhead.

Figure 6:
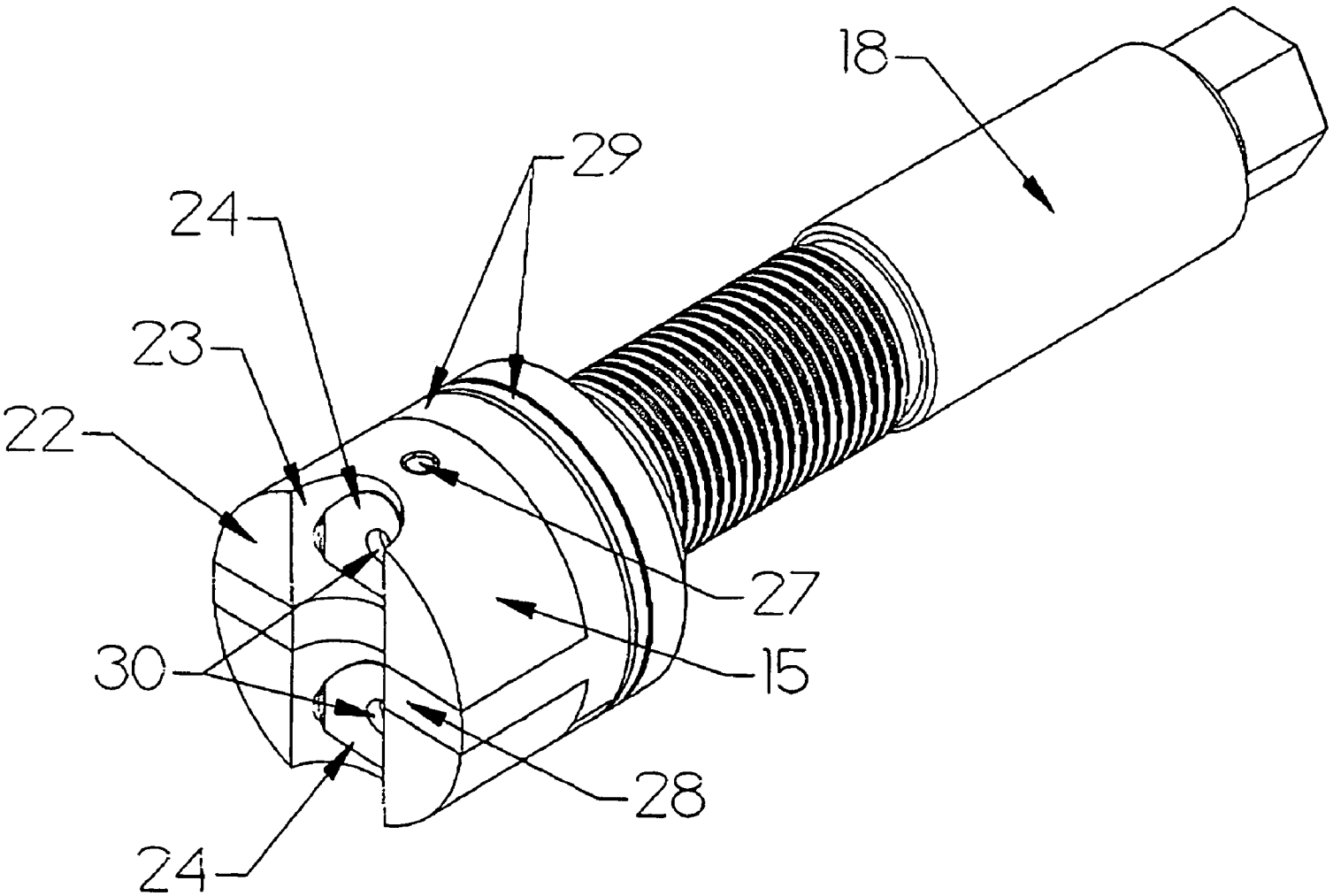
FIG. 6 is a side perspective view of a ram of a pump rod clamp and blowout preventer according to a preferred embodiment of the invention.
Figure 7:
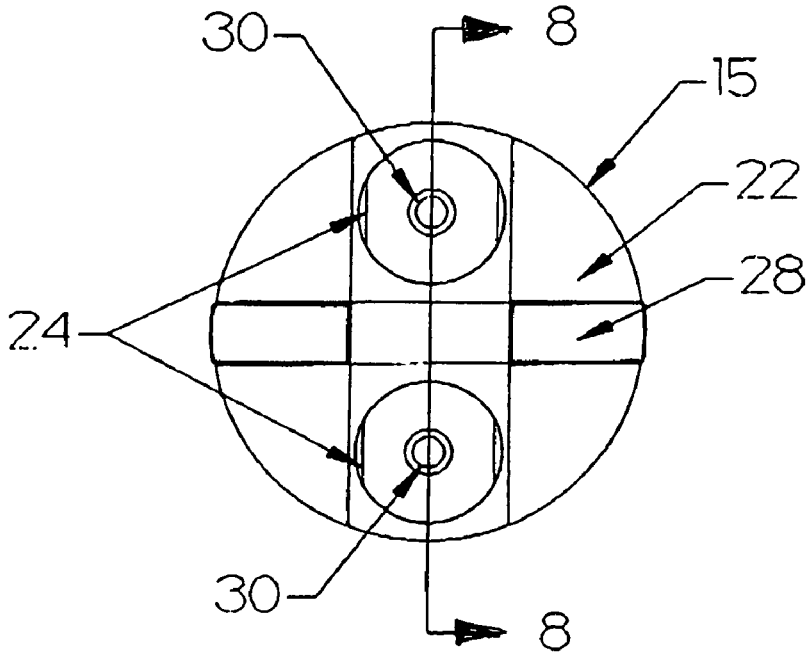
FIG. 7 is a front or end view of the face of the ram of FIG. 6.
Figure 8:
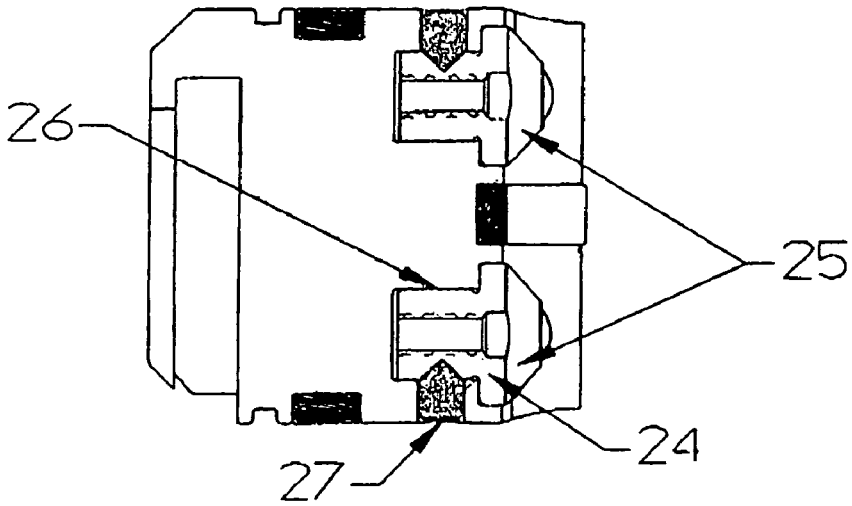
FIG. 8 is a sectional view taken along the line 8—8 of FIG. 7.

In a preferred embodiment of the invention each ram contains a pair of gripping inserts 24 that are generally in vertical alignment. The individual gripping inserts may be releasably secured to the ram in a variety of ways. For example, in the attached drawings the inserts are received within bores 26 within the leading face of each ram. Bores 26 and gripping inserts 24 may be threaded to allow the inserts to be screwed into the bores. Alternatively, and as shown in FIGS. 6 and 8, the gripping inserts may be pressed into the bores and held in place by means of pins or allen screws 27. In either instance, it will be appreciated that the gripping inserts may be easily and quickly replaced in the field should it become necessary. In a further embodiment of the invention, the gripping inserts 24 may include a longitudinal bore 30 extending therethrough (see FIGS. 7, 8, 11 and 13) to permit a pin or bolt to be screwed into the inserts so they may be "jacked" out of the face of the ram for replacement.

From a thorough understanding of the invention, those skilled in the art will appreciate that the described device may operate as a pump rod clamp to gripping secure or hold a pump rod in an oil, gas or water well. The device may also operate as a pump rod clamp and blowout preventer for both holding the pump rod and to seal the well to prevent or limit the escape of fluids therefrom. Where the device is constructed in such a fashion, clamping members 15 and 16 will sealingly engage against both the pump rod and one another to seal off the well. In this embodiment of the invention, the clamping members include an elastomeric seal 28 upon their leading faces. With the clamping members in their activated position, the seals on each ram will engage the exterior of the pump rod, and will engage each other within the annulus surrounding the pump rod, to maintain well control in a manner similar to the operation of currently available BOP's.

Additional seals 29 are positioned between the exterior surface of the rams and the interior surface of opposed radial bores 13 and 14 to prevent the escape of fluid therebetween. As in the case of conventional blowout preventers, seals 28 and 29 may be either separate sealing elements or may be of unitary construction.

Figure 9:
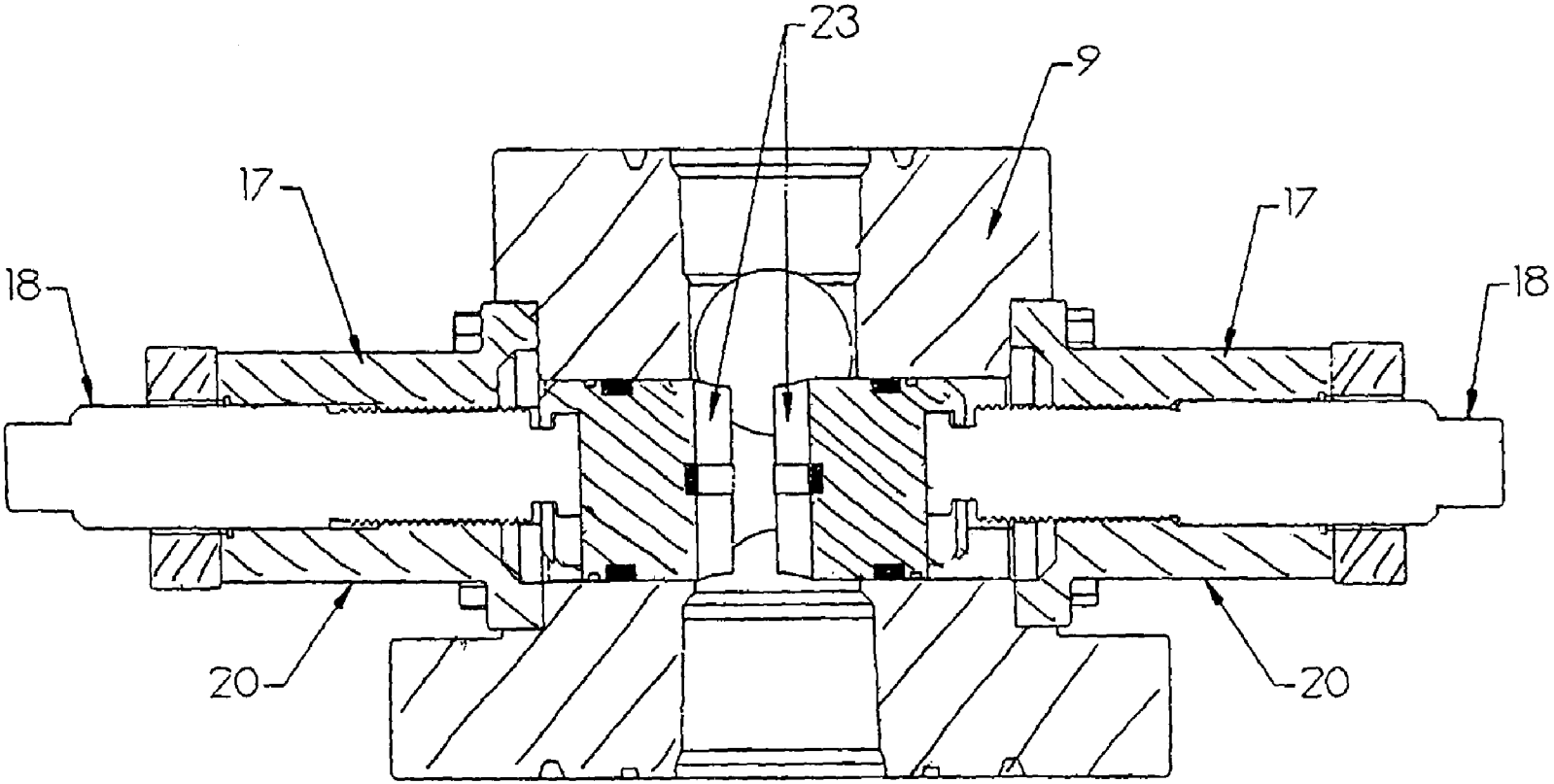
FIG. 9 is a side sectional view of an alternate embodiment of the pump rod clamp and blowout preventer of the present invention.
Figure 13:
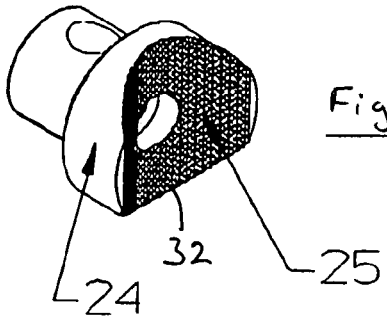
FIG. 13 is an upper side perspective view of the gripping insert of FIG. 10; and, FIG. 14 is an upper side perspective view of the pump rod clamp and blowout preventer.
Figure 10:
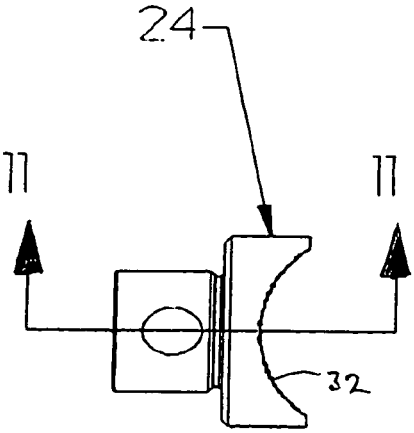
FIG. 10 is a side elevational view of a gripping insert in accordance with one embodiment of the invention.
Figure 12:
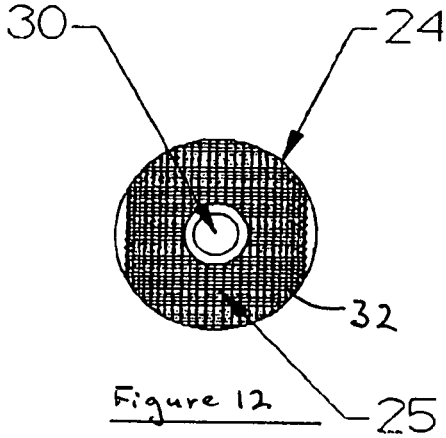
FIG. 12 is a front view of the gripping insert of FIG. 10.
Figure 11:
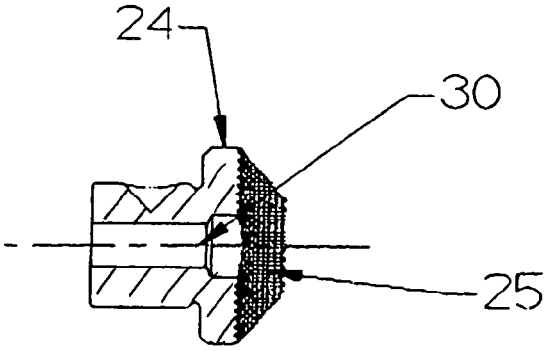
FIG. 11 is a sectional view along the line 11—11 of FIG. 10.

FIG. 9 shows an alternate embodiment of the invention wherein the arcuate channels 23 on the clamping members or rams are themselves coated with a ceramic material and contact the exterior surface of the pump rod directly when the rams are moved to their activated position. As in the case of the embodiment described above, coating the contact portions of the rams with ceramic material enhances the ability of the rams to engage the pump rod and to prevent or limit rotational and axial movement of the rod without scoring or galling the rod's outer surface. The lack of metal-to-metal contact between the rams and the rod once again presents an electrically insulative barrier between the pump rod and the rams, minimizing the risk of sparks, static shocks or arcing in the event of a short in electrical components attached to the wellhead. With the clamping members in their activated position such that arcuate channels 23 grippingly engage the pump rod, the rams will also tend to seal the well to help prevent or limit the escape of fluids. In gas wells, high pressure wells, where hydrogen sulfide is present, or any other situation where an enhanced degree of well control is desired or necessary, the rams may include seals 28 and 29 that function essentially in the same manner as in the embodiments described above.

The pump rod clamp and blowout preventer described herein provides a mechanism by which a pump rod may be securely held within a well to prevent or limit rotational and/or axial movement of the rod while at the same time preventing or substantially limiting scoring and galling of the rod's surface. Minimizing or limiting scoring or galling of the rod reduces the likelihood of damage being caused to packing or sealing elements when the rod is removed from the well. The inclusion of a ceramic coating upon either gripping inserts (in one embodiment), or the face of the rams (in an alternate embodiment), enhances the ability of the device to firmly grasp the rod without causing damage to its outer surface, while presenting an electrically insulative barrier between the rod and the wellhead equipment. In the embodiment of the invention that includes removable gripping inserts positioned on the face of the rams, there exists the added advantage of concentrating the load applied by the rams to the rod upon the smaller surface area of the inserts. Should it become necessary to change a gripping insert on account of damage, or to accommodate a different sized rod, doing so can be accomplished quickly and easily in the field by merely removing the existing inserts and replacing them without the need to replace or machine the entire ram.

It is to be understood that what has been described are the preferred embodiments of the invention and that it may be possible to make variations to these embodiments while staying within the broad scope of the invention. Some of these variations have been discussed while others will be readily apparent to those skilled in the art.

We claim:

1. A pump rod clamp for gripping a pump rod in an oil, gas or water well, the pump rod clamp comprising:

(i) a central housing having a longitudinal bore for receiving a pump rod;

(ii) a plurality of clamping members receivable within said central housing; and, (iii) one or more actuators to cause said clamping members to be moved between an activated position where they grippingly engage the exterior surface of the pump rod and a deactivated position where they are released from contact with the exterior surface of the pump rod, each of said clamping members having a leading face that includes one or more gripping inserts releasably secured thereto, said gripping inserts having outer faces that are arcuate in shape and that generally correspond to the curvature of the exterior or the pump rod, said outer faces of said gripping inserts generally aligned with the exterior surface of the pump rod and grippingly engaging the pump rod when said clamping members are in said activated position such that force exerted by each individual clamping member is concentrated and transmitted by said outer faces of said one or more gripping inserts to the pump rod.

2. The device as claimed in claim 1 wherein the combined surface area of said outer faces of said gripping inserts upon each individual clamping member is less than the surface area of the portion of said leading face of said individual clamping member adjacent to the pump rod.

3. The device as claimed in claim 1 wherein said central housing includes a pair of opposed radial bores generally perpendicular to said longitudinal bore and having interior ends terminating at said longitudinal bore, said pump rod clamp including two clamping members, each in the general form of a ram receivable within said radially opposed bores.

4. The device as claimed in claim 1 wherein said gripping inserts are formed from hardened steel.

5. The device as claimed in claim 1 wherein said outer faces of said gripping inserts have an arcuate shape generally corresponding to the curvature of the exterior of the pump rod.

6. The device as claimed in claim 5 wherein said outer faces of said gripping inserts include ridges or teeth to enhance the gripping of the pump rod.

7. The device as claimed in claim 5 wherein said outer faces of said gripping inserts are coated with a ceramic material, said ceramic material enhancing the ability of said gripping inserts to grippingly engage the pump rod and providing an electrically insulative barrier between said pump rod clamp and the pump rod when said clamping members are in said activated position.

8. The device as claimed in claim 1 including a pair of clamping members radially opposed to one another within said central housing, when in said activated position said clamping members sealingly engaging against the pump rod and one another to limit the escape of fluids from the well.

9. The device as claimed in claim 8 wherein said clamping members include an elastomeric seal upon their leading faces, said elastomeric seal providing a sealing engagement between said clamping members and the exterior surface of the pump rod, and between the respective leading faces of said radially opposed clamping members.

10. A pump rod clamp for gripping a pump rod in an oil, gas or water well, the pump rod clamp comprising:

(i) a central housing having a longitudinal bore for receiving a pump rod, said central housing including at least one pair of opposed radial bores generally perpendicular to said longitudinal bore and having interior ends terminating at said longitudinal bore;

(ii) a ram received within each of said opposed radial bores, each of said rams having a leading face generally directed toward the exterior surface of the pump rod; and, (iii) one or more actuators to cause said rams to be moved within said opposed radial bores between an activated position where said rams grippingly engage the pump rod to limit rotational and axial movement thereof, and a deactivated position where said rams are disengaged from the pump rod, each of said rams including one or more gripping inserts releasably securable to their leading faces such that when said rams are in said activated position said gripping inserts contact the exterior surface of the pump rod, said gripping inserts having outer faces with an arcuate shape generally corresponding to the curvature of the exterior of the pump rod and coated with a ceramic material, said ceramic material enhancing the ability of said gripping inserts to grippingly engage the pump rod and providing an electrically insulative barrier between said pump rod clamp and the pump rod when said clamping members are in said activated position.

11. The device as claimed in claim 10 wherein the combined surface area of said outer faces of said one or more gripping inserts on each individual ram is less than the surface area of the portion of the leading face of said individual ram adjacent to the pump rod such that force exerted by each individual ram against the exterior surface of the pump rod is concentrated and distributed over said smaller surface area of said one or more gripping inserts.

12. The device as claimed in claim 10 wherein said outer faces of said gripping inserts include horizontal, vertical, or horizontally inclined ridges or teeth.

13. The device as claimed in claim 10 wherein said leading faces of said rams include an elastomeric seal for sealingly engaging the exterior surface of the pump rod and for sealing engagement of the leading faces of opposed rams to limit the escape of fluids from the well.

14. A clamping blowout preventer for gripping a pump rod in an oil, gas or water well, the clamping blowout preventer comprising:

(i) a central housing having a longitudinally oriented bore for receiving a pump rod, said central housing including at least two radially opposed bores generally perpendicular to said longitudinal bore and having interior ends terminating at said longitudinal bore;

(ii) a ram received within each of said radially opposed bores, each of said rams having a leading face generally directed toward the exterior surface of the pump rod, said leading faces of said rams including one or more gripping inserts releasably secured thereto said gripping inserts having outer faces that are arcuate in shape and that generally correspond to the curvature of the exterior or the pump rod;

(iii) at least one actuator to cause said rams to be moved between an activated and deactivated position, when in said activated position said rams driven inwardly toward the pump rod causing said outer faces of said gripping inserts to grippingly engage the exterior surface of the pump rod and to limit axial and rotational movement thereof, when in said deactivated position said rams retracted from the pump rod permitting said gripping inserts to be released from engagement with the pump rod; and, (iv) a seal secured to each of said rams such that the seals on opposed rams engage both the exterior surface of the pump rod and one another when said rams are in said activated position, to limit well fluids from escaping from the well.

15. The device as claimed in claim 14 wherein said outer faces of said gripping inserts of each individual ram have a combined surface area less than the surface area of the portion of said leading face of said individual ram adjacent to the pump rod such that force exerted by each individual ram against the exterior surface of the pump rod is concentrated and distributed over said smaller surface area of said one or more gripping inserts.

16. The device as claimed in claim 14 wherein said outer faces of said gripping inserts are coated with a ceramic material that enhances the engagement of said gripping inserts with the exterior surface of the pump rod and that presents an electrically insulative connection therebetween.

17. The device as claimed in claim 16 wherein said gripping inserts include horizontal, vertical or horizontally inclined ridges or teeth upon their outer faces.

18. The device as claimed in claim 14 wherein said seals are comprised of elastomers, said elastomers further providing seals between said rams and said radially opposed bores to limit the passing of well fluids therebetween.

19. The device as claimed in claim 14 wherein the leading face of each of said rams includes and arcuate channel thereon, said arcuate channel in general alignment with the pump rod, said gripping inserts releasably secured to said rams within said arcuate channel.

20. A pump rod clamp for gripping a pump rod in a oil, gas or water well, the pump rod clamp comprising:

(i) central housing having a longitudinal bore for receiving a pump rod;

(ii) a plurality of clamping members received within said central housing; and, (iii) one or more actuators to cause said clamping members to be moved between an activated position where they grippingly engage the exterior surface of the pump rod and a deactivated position where they are released from contact with the exterior surface of the pump rod, each of said clamping members comprising a ram received within a radial bore extending through said central housing generally perpendicular to said longitudinal bore and having an interior end terminating at said longitudinal bore, each of said rams having a leading face with an arcuate channel thereon for grippingly engaging the pump rod when said rams are in said activated position, said arcuate channel coated with a ceramic material to enhance the ability of said arcuate channel to grippingly engage the pump rod and to provide an electrically insulative barrier between said pump rod clamp and the pump rod when said rams are in said activated position.

* * * * *